US007993023B2

(12) United States Patent
Wang

(10) Patent No.: US 7,993,023 B2
(45) Date of Patent: Aug. 9, 2011

(54) HAND TOOL WITH AN ILLUMINATING DEVICE

(76) Inventor: Chien-Kuo Wang, Taipei (TW)

( * ) Notice: Subject to any disclaimer, the term of this patent is extended or adjusted under 35 U.S.C. 154(b) by 125 days.

(21) Appl. No.: 12/560,438

(22) Filed: Sep. 16, 2009

(65) Prior Publication Data

US 2011/0063820 A1 Mar. 17, 2011

(51) Int. Cl.
*B25B 23/18* (2006.01)

(52) U.S. Cl. ..... 362/119; 362/120; 81/490

(58) Field of Classification Search ..... 362/119, 362/120; 81/177.4, 490
See application file for complete search history.

(56) References Cited

U.S. PATENT DOCUMENTS 5,566,596 A * 10/1996 Lin ..... 81/490
5,873,648 A * 2/1999 Shiao ..... 362/119
5,913,596 A * 6/1999 Lin ..... 362/120
6,196,695 B1 * 3/2001 Lai ..... 362/119
6,305,815 B1 * 10/2001 Lin ..... 362/119
6,318,875 B1 * 11/2001 Hrabar et al. ..... 362/119
2005/0090851 A1 * 4/2005 Devlin ..... 606/186

* cited by examiner

*Primary Examiner* — Stephen F Husar
*Assistant Examiner* — Peggy A. Neils

(57) ABSTRACT

A hand tool with an illuminating device includes a handle having a receiving space defined therein. A holding seat is received in the receiving space. The holding seat has a battery chamber defined therein, a shank chamber defined therein, and a plurality of bit holders formed thereon. A tool set is received in the holding seat. The tool set includes a plurality of tool bits detachably held in the bit holders and a tool shank detachably received in the shank chamber. The tool shank has a coupling portion extending therefrom and a connecting portion formed thereon for detachably connecting to any one of the tool bits. An illuminating device is received in the receiving space and electrically connected to the holding seat. The illuminating device has a coupling slot defined axially therein for engaging with the coupling portion of the tool shank.

6 Claims, 4 Drawing Sheets

HAND TOOL WITH AN ILLUMINATING DEVICE

BACKGROUND OF THE INVENTION

1. Field of the Invention

The present invention relates to a hand tool with an illuminating device, and more particularly to a hand tool having a detachable tool set and being able to be operated with an illuminating effect.

2. Description of Related Art

A conventional screwdriver with an illuminating device in accordance with the prior art generally includes a handle and a shank mounted in a central axial hole defined in the handle. A tool bit is connected to the shank. The handle has a top recess defined in an upper end thereof and a bottom recess defined in a lower end of the handle. An electrical circuit has a plurality of light emitting diodes (LEDs) mounted thereon. The electrical circuit is received in the top recess. A light transparent shield covers on the LEDs and a top cap covers over the top recess. A battery seat holding at least one battery and a switch are received in the bottom recess. A bottom cap covers over the bottom recess. The switch, the at least one battery, the circuit board, and the LEDs are electrically connected, such that the LEDs are able to illuminate forwardly.

The conventional screwdriver provides illumination when operating the screwdriver in the dark, but the tool bit and the shank are irreplaceably mounted on the screwdriver. The tool bit or the shank is not able to be detached from the handle and stored in the handle. Therefore, it is inconvenient when different types of screwdrivers are required for operation.

The present invention has arisen to mitigate and/or obviate the disadvantages of the conventional hub for off-road motorcycle.

SUMMARY OF THE INVENTION

The main objective of the present invention is to provide an improved hand tool with an illuminating device.

To achieve the objective, the hand tool with an illuminating device in accordance with the present invention includes a handle having a receiving space defined therein and extending axially therethrough. The receiving space has a first opening defined in a first end of the handle and a second opening defined in a second end thereof opposite to the first end. The handle has an anti-slippery pattern disposed around an outer periphery thereof for being grasped firmly.

A holding seat is received in the receiving space and has a battery chamber defined therein for adapting to contain at least one battery in the battery chamber. The holding seat has a shank chamber defined therein and a plurality of bit holders formed thereon. A cover removably covers the second opening for positioning the holding seat inside the receiving space.

A tool set is storably received in the holding seat. The tool set comprises a plurality of tool bits detachably correspondingly held in the bit holders and a tool shank detachably received in the shank chamber. The tool shank has a coupling portion extending from one end thereof. The coupling portion of the tool shank is in a hexagonal shape. The tool shank has a connecting portion formed in the other end thereof opposite to the coupling portion for detachably connecting to any one of the tool bits.

An illuminating device is received in the receiving space and adjacent to the first opening. The illuminating device comprises an illuminator received in the receiving space and a holder covered on the illuminator. The holder has an annular flange outwardly formed on an outer periphery of one end thereof. A bottom surface of the annular flange abuts against the first opening. The holder has a coupling slot defined centrally therein. The coupling slot is hexagonal and corresponds to the coupling slot for detachably engaging with the coupling portion of the tool shank. A magnet is received in the coupling hole for magnetically positioning the coupling portion.

The holder has a plurality of through holes axially defined therein and located around the coupling hole. The illuminator has a plurality of light emitting diodes disposed thereon for being correspondingly inserted into the through holes. The illuminator is electrically connected to the holding seat for adapting to connect to the at least one battery, such that electricity is provided to the light emitting diodes.

The handle further comprises a retainer having a retaining hole centrally defined therein and extending therethrough. The retainer is removably sleeved on the first end of the handle. The retainer has a retaining flange annularly formed on an inner periphery of the retaining hole for abutting against a top surface of annular flange opposite to the bottom surface.

Therefore, the tool set is able to be stored inside the handle. When the tool shank and the tool bit are assembled on the handle, the hand tool is able to be operated with illumination.

Further benefits and advantages of the present invention will become apparent after a careful reading of the detailed description with appropriate reference to the accompanying drawings.

DETAILED DESCRIPTION OF THE INVENTION

Figure 1:
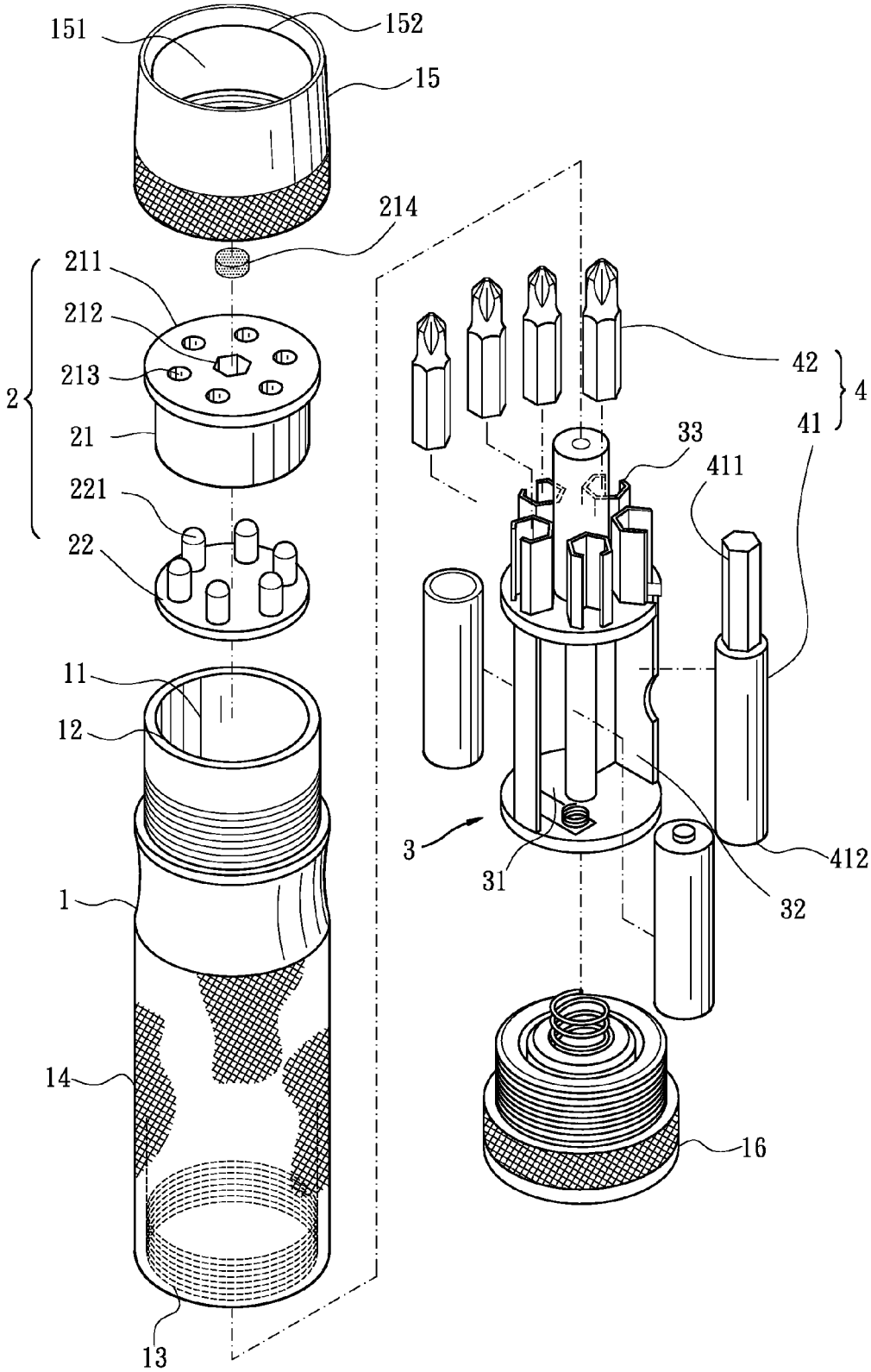
FIG. 1 is an exploded perspective view of a preferred embodiment of a hand tool with an illuminating device in accordance with the present invention.
Figure 2:
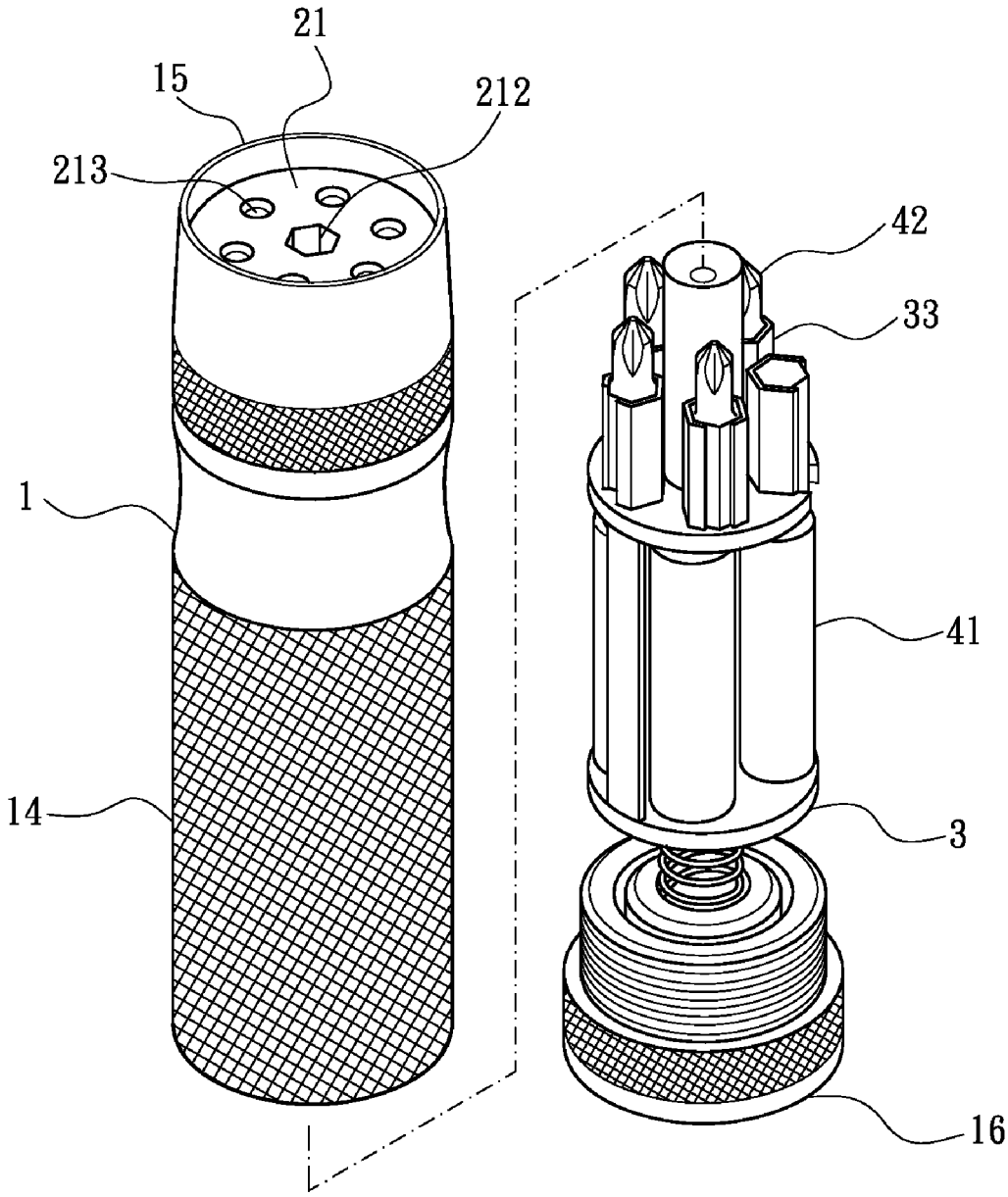
FIG. 2 is a partially assembled perspective view of the preferred embodiment of the hand tool with an illuminating device in accordance with the present invention.
Figure 3:
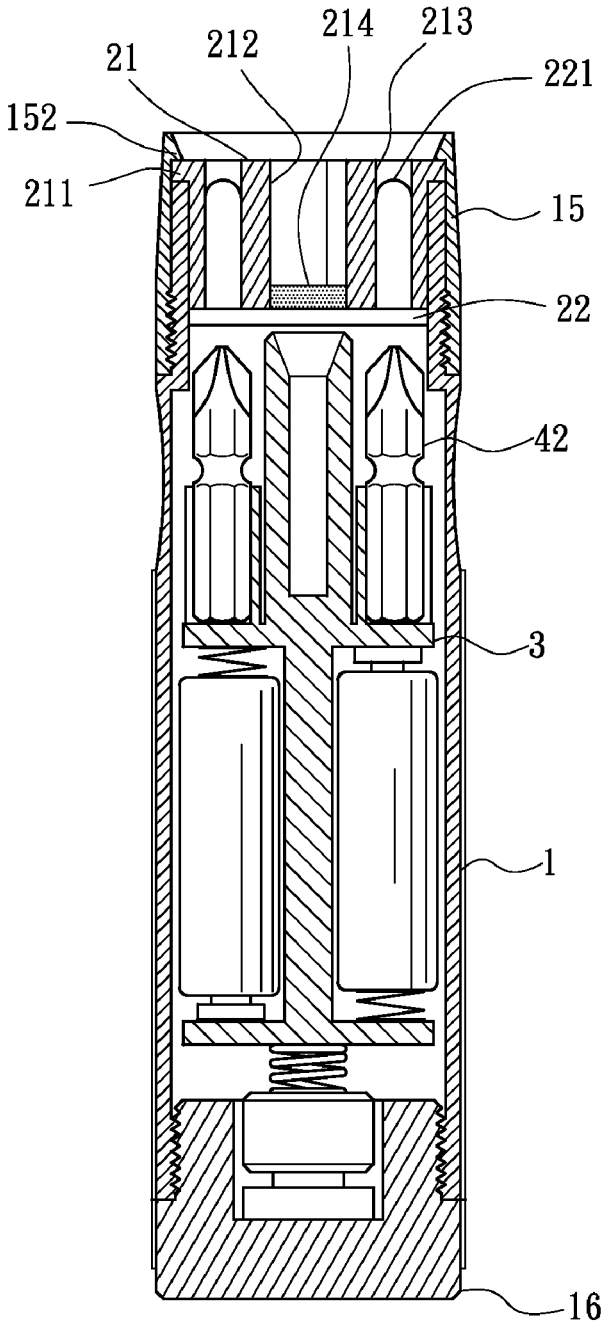
FIG. 3 is an assembled cross-sectional plane view of the preferred embodiment of the hand tool with an illuminating device in accordance with the present invention.
Figure 4:
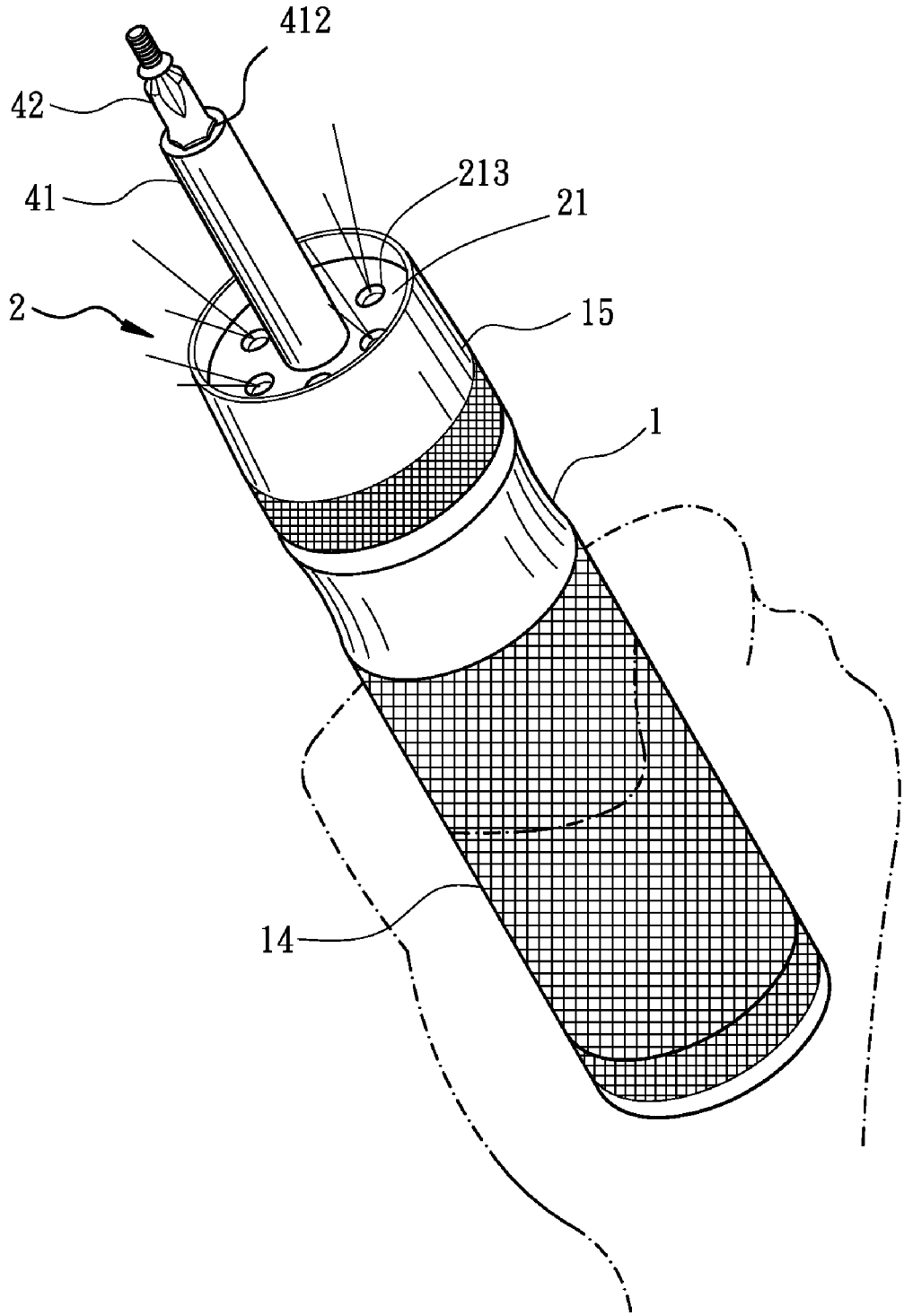
FIG. 4 is a perspective view of the preferred embodiment of the hand tool with an illuminating device under operation in accordance with the present invention.

Referring to the drawings and initially to FIGS. 1-4, a hand tool with an illuminating device in accordance with the present invention comprises a handle 1 having a receiving space 11 defined in a centre thereof and extending axially therethrough. The receiving space 11 has a first opening 12 defined in a first end of the handle 1 and a second opening 13 defined in a second end of the handle 1 opposite to the first end. The handle 1 has an anti-slippery pattern 14 disposed around an outer periphery thereof for grasping firmly.

A holding seat 3 is detachably received in the receiving space 11 and adjacent to the second end of the handle 1. The holding seat 3 has a battery chamber 31 defined in a lower part thereof for adapting to contain at least one battery in the battery chamber 31. The holding seat 3 has a shank chamber 32 defined therein and located beside the battery chamber 31. The holding seat 3 has a plurality of bit holders 33 annularly formed on an upper part thereof. A cover 16 removably covers the second opening 13 for positioning the holding seat 3 inside the receiving space 11.

A tool set 4 is storably received in the holding seat 3. The tool set 4 comprises a plurality of tool bits 42 detachably correspondingly held in the bit holders 33 and a tool shank 41 detachably received in the shank chamber 32. The tool shank 41 has a coupling portion 411 extending from one end thereof. The coupling portion 411 is in a hexagonal shape. The tool shank 41 has a connecting portion 412 formed on the other end thereof opposite to the coupling portion 411 for detachably connecting to any one of the tool bits 42.

The hand tool with an illuminating device further comprises an illuminating device 2 detachably received in the receiving space 11 and adjacent to the first opening 12. The illuminating device 2 comprises an illuminator 22 having a bottom abutting against a top of the holding seat 3 and a holder 21 covered on the illuminator 22. The holder 21 has an annular flange 211 outwardly formed on an outer periphery thereof. The annular flange 211 has a bottom surface abutting against the first opening 12. The holder 21 has a coupling slot 212 defined centrally thereof, such that the coupling portion 411 of the tool shank 41 detachably correspondingly engages with the coupling slot 212.

A magnet 214 is received in a bottom of the coupling slot 212 for positioning the coupling portion 411 of the tool shank 41. The holder 21 has a plurality of through holes 213 axially defined therein and located around the coupling slot 212. The illuminator 22 has a plurality of light emitting diodes 221 disposed thereon for being correspondingly inserted into the through holes 213. The illuminator 22 is electrically connected to the holding seat 3 for adapting to connect to the at least one battery, such that electricity is provided to the light emitting diodes 221.

A retainer 15 has a retaining hole 151 centrally defined therein and extending therethrough. The retainer 15 is removably sleeved on the first end of the handle 1. The retainer 15 has a retaining flange 152 annularly formed on an inner periphery of the retaining hole 151 for abutting against a top surface of the annular flange 211, wherein the holder 21 is clamped by the retainer 15 and the first opening 12 on the handle 1.

As described above, when the tool set 4 is stored in the holding seat 3 and received inside the receiving space 11, the hand tool is able to provide illumination which is emitted from the LEDs 221 via the through holes 213 and the retaining hole 151. When the hand tool is in an operational condition, one of the tool bits 42 connects to the connecting portion 412 of the tool shank 41. The coupling portion 411 engages with the coupling slot 212 and magnetically positioned by the magnet 214. The LEDs 221 provide light passing through the through holes 213 and the retaining hole 151 for illumination.

Although the invention has been explained in relation to its preferred embodiment, it is to be understood that many other possible modifications and variations can be made without departing from the spirit and scope of the invention as hereinafter claimed.

What is claimed is:

1. A hand tool with an illuminating device comprising:

a handle having a receiving space defined therein and extending axially therethrough, the receiving space having a first opening defined in a first end of the handle;

a holding seat received in the receiving space and having a battery chamber defined therein for adapting to contain at least one battery in the battery chamber, the holding seat having a shank chamber defined therein and a plurality of bit holders formed thereon;

an illuminating device comprising an illuminator received in the receiving space, a holder covered on the illuminator, the holder having an annular flange outwardly formed on an outer periphery of one end thereof, a bottom surface of the annular flange abutting against the first opening, the coupling slot defined centrally in the holder, the holder having a plurality of through holes axially defined therein, the through holes being located around the coupling hole, the illuminator having a plurality of light emitting diodes disposed thereon for being correspondingly inserted into the through holes, the illuminator electrically connected to the holding seat such that electricity is provided to the light emitting diodes; and a tool set received in the holding seat, the tool set comprising:

a plurality of tool bits detachably correspondingly held in the bit holders; and a tool shank detachably received in the shank chamber, the tool shank having a coupling portion extending from one end thereof for detachably engaging with the coupling slot, the tool shank having a connecting portion formed in the other end thereof opposite to the coupling portion for detachably connecting to any one of the tool bits.

2. The hand tool with an illuminating device as claimed in claim 1, wherein the handle has a second opening defined in a second end thereof opposite to the first end, a cover removably sealingly covering the second opening.

3. The hand tool with an illuminating device as claimed in claim 1, wherein the handle comprises a retainer having a retaining hole centrally defined therein and extending therethrough, the retainer removably sleeved on the first end of the handle, the retainer having a retaining flange annularly formed on an inner periphery of the retaining hole for abutting against a top surface of annular flange opposite to the bottom surface.

4. The hand tool with an illuminating device as claimed in claim 1, wherein the coupling slot is hexagonal, the coupling portion of the tool shank is in a hexagonal shape corresponding to the coupling slot.

5. The hand tool with an illuminating device as claimed in claim 1, wherein the holder comprises a magnet received in the coupling hole for magnetically positioning the coupling portion of the tool shank.

6. The hand tool with an illuminating device as claimed in claim 1, wherein the handle has an anti-slippery pattern disposed around an outer periphery thereof.

* * * * *